United States Patent [19]

Lundqvist

[11] Patent Number: 4,585,129

[45] Date of Patent: Apr. 29, 1986

[54] DIAGONALLY STIFFENED STRUCTURE AND METHOD OF FORMING SAME

[76] Inventor: Harald Lundqvist, Chemin des Cuarroz 21, CH-1807 Blonay, Switzerland

[21] Appl. No.: 589,074

[22] PCT Filed: Jun. 9, 1983

[86] PCT No.: PCT/SE83/00238

§ 371 Date: Feb. 21, 1984

§ 102(e) Date: Feb. 21, 1984

[87] PCT Pub. No.: WO84/00288

PCT Pub. Date: Feb. 2, 1984

[30] Foreign Application Priority Data

Jul. 14, 1982 [SE] Sweden ..... 8204319

[51] Int. Cl.[4] ..... A47B 47/00; A47F 43/00; A47F 57/00; B21D 39/00

[52] U.S. Cl. ..... 211/189; 29/446; 29/452; 29/526 R; 52/291; 52/640

[58] Field of Search ..... 29/446, 526 R, 452, 29/155 R; 52/291, 640, 222; 211/153, 189; 244/153 R

[56] References Cited

U.S. PATENT DOCUMENTS

| | | | |
|---|---|---|---|
| 1,912,808 | 6/1933 | Watson | 244/153 R |
| 1,975,900 | 10/1934 | Kuenhold | 211/189 X |
| 2,122,155 | 6/1938 | Schlatt | 52/291 |
| 2,597,786 | 5/1952 | Fontaine | 52/291 X |
| 2,696,644 | 12/1954 | De Graw | 52/291 X |
| 2,722,721 | 11/1955 | Carlow | 52/291 |
| 2,887,234 | 5/1959 | Huey et al. | 211/189 |
| 3,007,233 | 11/1961 | Dean et al. | 29/155 R |
| 3,185,314 | 5/1965 | Orser | 29/452 X |
| 4,292,902 | 10/1981 | Barrineau | 211/153 X |

FOREIGN PATENT DOCUMENTS

| | | | |
|---|---|---|---|
| 830417 | 7/1938 | France | 52/291 |

*Primary Examiner*—Charlie T. Moon

*Attorney, Agent, or Firm*—Kinzer, Plyer, Dorn & McEachran

[57] ABSTRACT

The disclosure relates to shelving structures and other structures which, for reasons of stability, require reliable stiffening diagonally in one or more planes, by means of two mutually intersecting wire-like or rod-like stays (3, 4), the ends (5) of which are attached to the structure at four attachment locations (7). The erectness of the structure, for example on an uneven foundation, and the extent to which it can sway are both dependent upon the stays being brought to the correct length and tension between respective attachment locations. This has previously either been neglected or achieved with the aid of robust, expensive and complicated tensioning mechanisms, primarily tensionscrews, used to shorten the stays. A much simpler solution is afforded by the disclosure, according to which the point of intersection of the stays (3, 4) is displaced in the respective transverse directions of the stays (3, 4), while at the same time holding the structure fixed in its intended position, until the stays (3, 4) have both been tensioned to the same, desired extent, in which position the stays are connected together, either detachably or permanently, at said point of intersection by means of a suitable joint means (8, 9, 10), for example a spot weld or a screw joint. When a screw joint (8, 9, 10) is used, the joint can be tightened from the front of a shelving structure (1, 2) placed against a wall.

4 Claims, 9 Drawing Figures

DIAGONALLY STIFFENED STRUCTURE AND METHOD OF FORMING SAME

The present invention relates to a method for stiffening a structure diagonally, by means of two mutually intersecting wire-like or rod-like stays, which are attached to the structure at four attachment locations, and to devices for carrying out the method.

With previously known methods and devices intended for the aforementioned purpose, the ends of the stays are normally screwed into the construction while stretching the stays and locating the structure in its intended position. It is difficult to tension the stays precisely to the extent required, and as a rule some final adjustments need to be made, these adjustments requiring the arrangement of special tools for each of the stays, for example the arrangement of tensioning devices, such as tensionscrews. When the structure is a shelving-frame structure requiring diagonal stays on the rear side thereof, the aforesaid devices must be mounted, and possibly adjusted, from the rear of the shelving structure. This is impracticable, and the arrangement of associated attachment and tensioning means is relatively expensive.

The object of the present invention is to provide a substantially simpler and more readily handled stay arrangement for stiffening structures diagonally.

This object is realized in accordance with the invention by means of the method and the device set forth in the following claims.

Thus, the stays can be readily mounted without requiring precise initial adjustment of the stays and without requiring the structure to be fixed in its precise upright position at the same time as making the mounting operation. The stays are namely adjusted in a subsequent operation, firstly by displacing the point of intersection of the stays in a manner such that one or both stays become slightly curved, whereafter the stays are firmly connected together at said displaced point of intersection, i.e. connected either permanently or detachably.

For example, when mass producing open-rung shelving supports, where the structure is stiffened diagonally, the aforementioned connection can be made in a simple and ready fashion, by means of a spot weld made at each displaced stay-intersection point. The connection can also be made manually, for exmaple when assembling the structure in its intended location, suitably by means of a friction fastener provided with screws, the fastener being arranged to clamp firmly around the stays at said point of intersection. Even a light tightening of the fastener has been found to provide surprisingly reliable and positive retention of the stays. Such a friction fastener enables subsequent adjustments to be made with ease, for example when it is subsequently found necessary to move the shelving structure slightly, on an uneven floor, or in the event of subsequent settling of the floor on which the structure stands, causing the shelving structure to be crooked and therefore making final adjustments necessary. In this respect, in accordance with a particularly preferred embodiment of the invention, the friction fastener is suitably designed so that the fastener can be loosened, adjustments made, and the fastener re-tightened, all from the front of the shelving structure, i.e. so that the shelving structure, for example, need not be moved away from a wall in order to make the ncessary adjustments, and then moved back against the wall.

The invention will now be described in more detail with reference to a number of embodiments of arrangements according to the invention illustrated in the accompanying drawings, in which drawings, FIG. 1 is a rear view of a staging structure stiffened diagonally in accordance with the invention;

FIG. 2 is a part view, illustrating the anchoring of one of the ends of the stays in FIG. 1;

FIG. *3a* is a side view, and

FIG. *3b* a front view of the joint connection at the point of intersection of the stays in FIG. 1;

Figure 7:
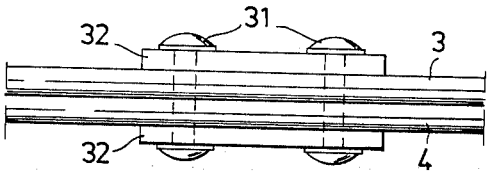

FIGS. *6a* and *6b* are front views and side views respectively, showing how the stays can be anchored with a spot weld;

FIG. 7 is a part view, from the side of a rivet joint at said point of intersection.

Figure 1:
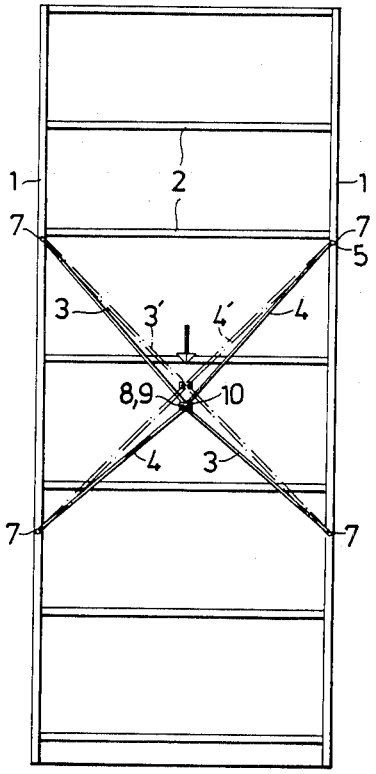
Figure 2:
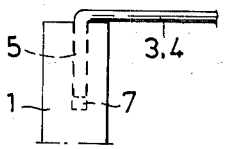

FIG. 1 illustrates a shelving structure having wooden side-pieces 1 and movable shelves 2. The structure is sitffened diagonally by two mutually intersecting stays each of which comprises a robust steel rod 3,4, the ends 5 of which are bent to an angle of 90° and forced into holes 7 (see FIG. 2) drilled in the rear edges of the side-pieces. In the initial stages of the erection procedure, the stays are more or less relaxed and extend along the straight line 3', 4' connecting respective pairs of attachment points, represented here by the drilled holes 7. As illustrated in FIGS. *3a*, *3b*, there is loosely mounted on the stays at their point of intersection a friction-joint means comprising two plates 8, 9 located on a respective side of the stays 3, 4 at said intersection point, the plates being held together by two screws 10, which pass freely through holes in the plate 9 and are screwed into screw-threaded holes in the plate 8.

With the shelving structure held in position, and the side-pieces 1 vertical, the joint 8, 9, 10 is displaced in the lateral direction of the stays, so that the stays are equally tensioned, whereupon the screws 10 are tightened, so that the joint cannot be subsequently displaced. If the heads of the screws 10 are made to face towards the front of the structure, the screws can be readily tightened, even when the shelving structure is placed with its back against the wall.

Figure 4:
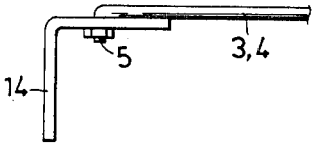
FIG. 4 shows the end of one stay anchored in an angled, shaped section.
Figure 5:
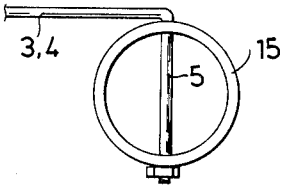
FIG. 5 is a view showing the ends of the stays anchored in a tube.
Figure 6A:
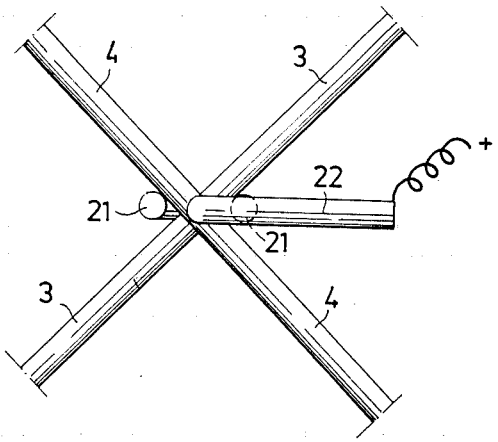
Figure 6B:
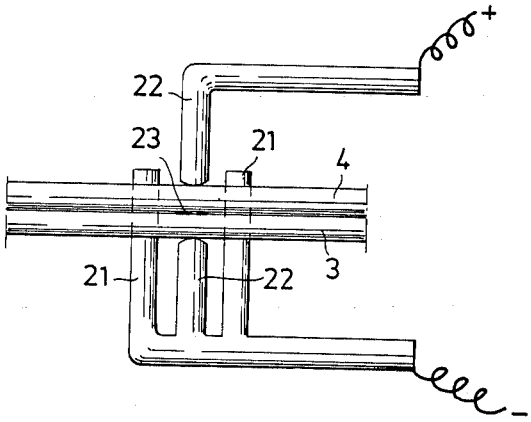

The invention is not solely restricted to use with shelving structures, but can be used generally with structures comprising, for example, angled sections 14 (FIG. 4) and/or tubular sections 15 (FIG. 5), where mutually intersecting stays can be used, for example such structures as uncomplicated bridges, masts and towers of lattice or openframework construction.

In the case of mechanical manufacture of, for example, sections of structures which do not normally require subsequent adjustment, and for example, in the case of openrunged shelving supports, the joint may have the form of spot welds made at the displaced intersection points. The manner in which such welds may be made is illustrated in FIGS. *6a* and *6b*. The point of intersection of the stays 3, 4 can be displaced, by means of a fork-shaped tool 21, to a position determined by the tension required in stays 3, 4. Two welding heads 22 are arranged to follow the movements made by the tool 21, and when the intersection point has the correct setting, the welding heads 22 are pressed against mutually opposite sides of the stays 3, 4 at said intersection point, whereupon welding current is supplied, so as to obtain a spot weld 23 at said point of intersection.

Figure 3A:
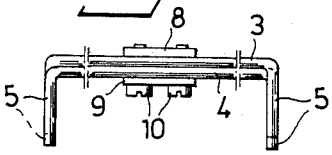
Figure 3B:
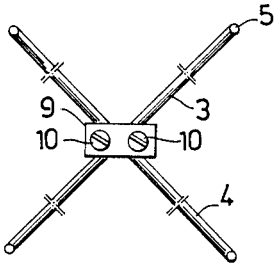

Alternatively a reliable joint can be obtained by replacing the screws 10 of the embodiment illustrated in FIGS. 3*a*, 3*b* with two rivets 31, arranged to press two perforated plates 32 against mutually opposite sides of the stays 3, 4, as illustrated in FIG. 7. A certain amount of final adjustment can also be obtained with this joint means, since the joint can be knocked laterally with a hammer or like tool.

As will be understood, only one of the screws 10 of the FIGS. 3*a*, 3*b* embodiment need be replaced with a rivet. Furthermore, the friction joint may also comprise a U-shaped plate held by a single screw.

Tests have shown that the exact displacement of the above friction joint can be obtained automatically by forcing the joint laterally, whereupon one or both stays will be bent precisely to the extent required, without requiring the joint to be guided in a given direction or any measurements to be made. The whole operation can be effected in less than one second, only the time required for subsequent tightening of the joint remaining.

I claim:

1. A method for stiffening and stressing a rigid rectangular frame structure diagonally by means of two mutually intersecting wire-like or rod-like stays which are attached to the structure at four attachment locations, characterized by displacing the intersection point of said stays that are attached at said four attachment locations in the transverse directions of respective stays, while at the same time holding the structure fixed in its intended position until both stays are under the same, desired amount of tension, and then firmly connecting the stays together at said displaced point of intersection, by spot-welding said stays at said location or by screwing or riveting said stays together with the aid of a suitable fitting.

2. A stiffened and stressed rigid rectangular frame structure formed by the method according to claim 1.

3. A structure according to claim 2, characterized in that the joint means is a friction joint (8, 9, 10; 31, 32) arranged to clamp the stays together.

4. A structure according to claim 3, wherein the structure is a shelving structure (1, 2) having an open back, characterized in that the friction joint (8, 9, 10) has a tightening means (10) which can be reached from the front of the shelving structure (1, 2).

* * * * *